US005975661A

United States Patent [19]

Jeziorowski et al.

[11] Patent Number: 5,975,661

[45] Date of Patent: Nov. 2, 1999

[54] REFRIGERATOR DOOR SEAL ASSEMBLY

[75] Inventors: Les Jeziorowski, Coquitlam; Nedo Banicevic, Hamilton; Arnold Estravillo, Hamilton; Edward George Simmons, Hamilton, all of Canada

[73] Assignee: Camco Inc., Mississauga, Canada

[21] Appl. No.: 09/192,245

[22] Filed: Nov. 16, 1998

[30] Foreign Application Priority Data

Mar. 5, 1998 [CA] Canada ..... 2231319

[51] Int. Cl.[6] ..... A47B 96/00

[52] U.S. Cl. ..... 312/296; 312/405; 49/478.1

[58] Field of Search ..... 49/309, 310, 329, 49/366, 478.1, 479.1, 480.1, 483.1, 495.1; 312/324, 405, 400, 296

[56] References Cited

U.S. PATENT DOCUMENTS

| | | | |
|---|---|---|---|
| 1,918,911 | 7/1933 | Hull . | |
| 2,565,891 | 8/1951 | Sherman | 292/1 |
| 2,692,809 | 10/1954 | Kesling | 312/214 |
| 2,723,896 | 11/1955 | Wurtz | 312/296 |
| 2,859,495 | 11/1958 | Roberts | 49/480.1 |
| 3,004,309 | 10/1961 | Korodi | 20/69 |
| 3,070,852 | 1/1963 | Hilliker | 20/16 |
| 3,077,644 | 2/1963 | Kesling | 20/69 |
| 3,216,776 | 11/1965 | Carbary | 312/296 |
| 3,226,367 | 12/1965 | Monti | 20/69 |
| 3,248,159 | 4/1966 | Hall | 312/296 |
| 3,264,048 | 8/1966 | Koch et al. | 312/296 |
| 3,362,108 | 1/1968 | Jones | 49/478 |
| 3,382,618 | 5/1968 | Townsend | 49/483 |
| 3,408,772 | 11/1968 | Frehse | 49/366 |
| 3,461,610 | 8/1969 | Peters et al. | 49/478 |
| 3,466,804 | 9/1969 | Swaneck, Jr. | 49/483 |
| 3,487,581 | 1/1970 | Ellinson, Jr. | 49/478 |
| 3,726,578 | 4/1973 | Armstrong | 312/214 |
| 3,942,853 | 3/1976 | Grimm et al. | 312/296 |
| 4,226,489 | 10/1980 | Haag | 312/296 |

(List continued on next page.)

FOREIGN PATENT DOCUMENTS

| | | | |
|---|---|---|---|
| 1146621 | 5/1983 | Canada | 312/73 |
| 490928 | 8/1994 | European Pat. Off. | 3/6 |

*Primary Examiner*—Peter M. Cuomo
*Assistant Examiner*—Gerald Anderson

[57] ABSTRACT

A refrigerator has French doors with vertically extending confronting side walls. At least one of the confronting side walls has a movable sealing gasketing member adapted to sealingly engage the other confronting side wall when the doors are in a closed position. The doors move between an open position and into the closed position through a temporary intermediate partially closed position. In the partially closed position the doors extend over the refrigerator compartment with temporary non-sealing vertically extending portions of the confronting side walls of the doors spaced apart from one another a predetermined gap distance. A first set of magnets are positioned in the doors at least along the temporary non-sealing vertically extending portions of the confronting side walls. The first magnets have a magnetic field attraction strength insufficient to move the gasketing member across the predetermined gap distance and sufficient to seal the gasketing member to the other confronting side wall when the predetermined gap distance is reduced. A second set of magnets have a magnetic field strength greater than the first magnets. The second magnets are positioned in at least one location along each of the confronting side walls to trigger local movement of the gasketing member towards the other confronting side wall locally reducing the predetermined gap. This triggers the first magnets to move the gasket along the vertically extending portions into sealing engagement with the other side wall. In the preferred embodiment the second magnets are located as a continuation of and in alignment with the first magnets. Swiping of the confronting side walls of the doors is limited at the second magnets.

34 Claims, 11 Drawing Sheets

U.S. PATENT DOCUMENTS

| | | | |
|---|---|---|---|
| 4,288,135 | 9/1981 | Buchser et al. | 312/296 |
| 4,469,383 | 9/1984 | Losert | 312/296 |
| 4,644,698 | 2/1987 | Gerdes et al. | 49/478 |
| 4,653,819 | 3/1987 | Swerbinsky | 312/296 |
| 4,702,038 | 10/1987 | Frey | 49/478 |
| 4,732,432 | 3/1988 | Keil et al. | 312/214 |
| 4,832,396 | 5/1989 | Moreno et al. | 296/164 |
| 4,916,864 | 4/1990 | Thompson | 49/478 |
| 5,129,184 | 7/1992 | Fish | 49/478 |
| 5,289,657 | 3/1994 | Kiel | 49/478.1 |
| 5,309,680 | 5/1994 | Kiel | 49/478.1 |
| 5,425,205 | 6/1995 | Ha | 49/366 |
| 5,551,192 | 9/1996 | Avendano et al. | 49/479.1 |
| 5,560,694 | 10/1996 | Banicevic et al. | 312/405 |
| 5,816,080 | 10/1998 | Jeziorowski | 62/441 |

REFRIGERATOR DOOR SEAL ASSEMBLY

TECHNICAL FIELD OF THE INVENTION

The present invention relates to a refrigerator door seal between facing door edges of a pair of doors. In particular the invention is directed towards a time delayed refrigerator door seal for use between two side-by-side doors which are adapted to close and thermally seal against each other across a single open front access to the refrigerator.

BACKGROUND OF THE INVENTION

For several years the trend in domestic refrigerator cabinets has been to increase the size and in particular the width of the food compartments which brought about the use of double doors. The advantage of the larger refrigerator however, is lessened by fitting side-by-side a freezer on one side and a refrigerator on the other side of a refrigerator cabinet with a center vertical mullion against which the side-by-side doors close. Omission of the vertical mullion to maintain the freezer compartment on the top, the fresh food compartment below and yet still have side-by-side doors, introduces the problem of effectively sealing the doors along their juxtapositioned facing sides. To provide a thermal and/or air seal between the facing surfaces of the doors when the doors are closed, compressible gaskets have been developed that extend along the side face of each door and contact each other during door closure. Each gasket includes magnets extending vertically along the length of the gasket. The magnets in opposing gaskets are oppositely poled so that the magnetic poles attract when the doors are aligned in a side-by-side closed position. During door opening when one door is moved relative to the other door, like poles of the magnets pass by each other causing the magnets to repel and move the gaskets apart reducing wiping contact of the gaskets. However, once these "repelling" magnets pass by each other, gasket wiping occurs along the entire vertical length of the gasket.

Many different magnetic gasket sealing assemblies for side-by-side or "French" doors used to close an open front of a refrigerator cabinet are disclosed in the U.S. patent literature. For example, U.S. Pat. No. 3,248,159 issued Apr. 26, 1996 to Charles Hall teaches the use of three sets of magnets in two gaskets. A first pair of magnets are arranged to attract and seal the two gaskets when the doors are in the closed position. This first pair of magnets are hingedly attached in a flexible gasket to a second pair of magnets, one in each gasket which pivot the gasket sealing faces to move the first pair of magnets out of contacting position relative to each other during opening and closing of the French doors to reduce wiping. The magnetic gasket seals are arranged forward of a recessed shoulder in each of the French doors.

U.S. Pat. No 3,264,048 issued Aug. 2, 1966 to A. J. Koch et al describes a magnetic gasket seal for French doors where the gaskets overlap each other in the direction of opening which causes a wiping action which reduces the life of the gasket. Other examples of French door magnetic gasket seals are described in U.S. Pat. No. 3,408,772 issued to Frehse on Nov. 5, 1968; U.S. Pat. No. 4,226,489 issued Oct. 7, 1980 to Charles Haag; U.S. Pat. No. 4,288,135 issued Sep. 8, 1981 to Buchser et al; U.S. Pat. No. 5,289,657 issued Mar. 1, 1994 to Lowell Kiel and U.S. Pat. No. 5,309,680 issued May 10, 1994 to Lowell Kiel. All of these French door closure gasket seals are subject to wiping along the entire vertical length of the adjacent facing gaskets during closure thereby effecting the proper closure of the doors and gasket sealing integrity over the life span of the gasket.

U.S. Pat. No. 2,723,896 issued to Wurtz on Nov. 15, 1955 discloses a refrigerator French door seal where the seal is held in place against a recessed lateral edge portion of one of the doors. The seal includes a magnet that runs the vertical length of the door and is positioned within the gasket adjacent the outside edge of the door. The magnet is attracted to the metal in the recess portion of the gasket against the recessed portion of the door when the doors are open. When the doors are moved into a closed position relative to each other, the magnet in the gasket is now closer to the confronting lateral edge of the other door and this causes the vertical length of the gasket to move horizontally into contact with the other door. While this patent discloses the use of only one gasket, the vertical length of the gasket moves simultaneously into swiping contact with the other door and there is no delay associated with gasket movement. The gasket moves into contact with the other door during door closure causing the gasket to swipe against the door and be subject to the problems discussed above.

The aforementioned patents are concerned with sealing of French doors by using sealing gaskets with magnets that cause one or more of the door gaskets to move relative to the other gasket during opening/closing operation to reduce the effects of wiping. These patents do not address the problem associated with continued simultaneous swiping of gaskets along the entire vertical length of the gasket the doors are moved into a closed position. This wiping action reduces the longevity of the door seal integrity between adjacent doors and provides the user with an un-sure feeling that the door may not be properly closed. In some instances, the force used to close the door may be insufficient to overcome the wiping along the length of the gaskets leaving the doors partially ajar.

French door gaskets must seal along their entire vertical length, which for the most part extends between the upper and lower peripheral walls of the refrigerator cabinet to provide an effective seal which also creates the problematic wiping along the vertical length of the gaskets. Further, as the width of the refrigerator cabinet increases and the size the weight of the double doors increases. This increases the stress placed on door sealing gaskets. As a result the effects of prolonged wiping along the vertical lengths of these gaskets affixed to the opposing juxtapositioned sides of the refrigerator may cause premature gasket deterioration and misalignment shortening the life of the seal. While the use of a vertical mullion overcomes this problem because the entire length of the sealing gasket can close against the vertical mullion to distribute evenly the door closing forces along the length of the gasket and mullion, the use of the mullion defeats the purpose of providing a refrigerator cabinet having a single access to either or both of the fresh food compartment and the freezer food compartment when these compartments are positioned vertically above one another. Clearly, the patent literature for at least the last 40 years has recognized the difficulty in manufacturing an effective French door gasket seal between vertically extending and confronting side walls of the side by side doors.

While the wiping problem associated with the closure of French door gasket seals has been recognized in the past, to overcome this wiping effect of the gaskets, redesign of the hinges in the refrigerator has occurred resulting in lateral movement of the doors relative to each other during the initial door opening stage and the end of the door closing stage. Such a hinge design is disclosed in European patent 490 928 granted Aug. 31, 1994 to Oy Electrolux AB. While the lateral motion imparted onto the door by the hinge design eliminates wiping contact between the lateral adjacent French door gaskets, disadvantages lie in the added hinge expense due to its increased complexity and the resultant increase in size of the hinge construction adversely affecting the appearance of the refrigerator.

Clearly, there is a need for an improved French door seal that reduces or eliminates swiping contact along the vertical length of confronting gasket seals during door closure without requiring an expensive hinging structure.

SUMMARY OF THE INVENTION

The present invention relates to a novel sealing arrangement for use with French doors of a refrigerator which close a single access opening into a food compartment for the refrigerator. The doors are pivotally mounted to a refrigerator cabinet for swinging movement between an open position permitting access to the refrigerator compartment through a temporary intermediate partially closed position to a closed position covering the refrigerator compartment. The doors having vertically extending confronting side walls with at least one of the confronting side walls having a movable sealing gasketing member adapted to sealingly engage the other confronting side wall when the doors extend across the open front of the refrigerator cabinet in a closed position. The doors while closing travel through a novel and advantageous temporary intermediate partially closed position in which the doors extend over the open front of the compartment with temporary non-sealing vertically extending portions of the confronting side walls of the doors spaced apart from one another a predetermined gap distance in side by side, non-wiping and non-contacting relation. In one aspect of the present invention, substantially the entire vertical extending confronting side walls are separated by a predetermined gap for a predetermined time delay while in the intermediate partially closed position. In this aspect of the present invention, swiping contact between the confronting side walls of the French doors is eliminated. In the preferred aspect of the present invention, one or more locations along the confronting side walls makes limited swiping contact during door closure with remaining temporarily non-sealing vertically extending portions of the confronting walls subsequently closing the predetermined gap distance. In this preferred embodiment, there is effectively no substantial time delay before initial swiping contact is made between the doors during closure, however, this initial swiping contact is limited to only those areas were local contact occurs. The temporary non-sealing vertical extending portions are spaced apart from each other in the partially closed position to eliminate swiping or contact of the vertical extending portions during swinging door closure motion, except perhaps adjacent points where local contact occurs. A more reliable door closure against the peripheral surface of the refrigerator cabinet is achieved because swiping is either eliminated or substantially reduced depending upon the aspect of the present invention utilized. Further, French door seal life integrity to repeated door closure is improved. The doors do not remain in the intermediate position for any extended period of time. In the preferred aspect a user will see the local contact of the doors in the intermediate partially closed position followed by a quick sliding closure along the rest of the confronting side walls as the gap distance is reduced.

The intermediate partially closed position and closed sealing positions of the door is achieved by the use magnets of varying strength. The doors include first magnetic attraction means positioned at least along the vertically extending non-sealing portions of the confronting side walls. The first magnetic attraction means have a magnetic field attraction strength insufficient to move the gasketing member across the predetermined gap distance and sufficient to seal the gasketing member to the other confronting side wall when the predetermined gap distance is reduced. A second magnetic attraction means has a magnetic field strength greater than the first magnet magnetic attraction means. The second magnetic attraction means is positioned in at least one location along the confronting side walls to trigger movement of the gasketing member towards the other confronting side wall to reduce the predetermined gap at the one location whereby the first magnetic attraction means adjacent the one location moves the vertically extending non-sealing portions of the confronting side walls across the reduced gap distance into sealing engagement.

In accordance with an aspect of the present invention there is provided a refrigerator comprising a refrigerator cabinet having at least one food storage compartment having an open front and a pair of French doors pivotally mounted to the refrigerator cabinet. The doors have vertically extending confronting side walls. At least one of the confronting side walls comprises a movable sealing gasketing member adapted to sealingly engage the other confronting side wall when the doors extend across the open front of the refrigerator cabinet in a closed position. The doors are movable between an open position, permitting access to the food compartment, and into the closed position through a temporary intermediate partially closed position. In the partially closed position the doors extend over the open front of the compartment with temporary non-sealing vertically extending portions of the confronting side walls of the doors spaced apart from one another a predetermined gap distance in side by side, non-wiping and non-contacting relation. The doors include a first magnetic attraction means positioned at least along the temporary non-sealing vertically extending portions of the confronting side walls. The first magnetic attraction means has a magnetic field attraction strength insufficient to move the gasketing member across the predetermined gap distance and sufficient to seal the gasketing member to the other confronting side wall when the predetermined gap distance is reduced. The doors include a second magnetic attraction means, having a magnetic field strength greater than the first magnetic attraction means, positioned in at least one location along each of the confronting side walls to trigger movement of the gasketing member towards the other confronting side wall to reduce the predetermined gap at the one location. As a result the first magnetic attraction means adjacent the one location moves the temporary non-sealing vertically extending portions of the confronting side walls across the reduced gap distance into sealing engagement.

Preferably, the gasketing member has a flexible confronting surface permitting initial sealing contact at the one location and subsequent sliding closure in a vertical direction away from the one location as the predetermined gap distance is reduced. The non-sealing vertical extending portions of the confronting side walls comprise a major length of each of said doors.

Preferably, the second magnet attraction means magnet is located as a continuation of and in alignment with the first magnet attraction means. The wiping of the confronting side walls of the doors occurs only at the one location adjacent the second magnetic means as the doors are moved into the partially closed position.

In an alternative embodiment, the second magnet attraction means includes a delayed sealing mechanism that triggers movement of the gasketing member towards the other confronting side a predetermined time delay period after the doors are moved into the intermediate partially closed position such that the confronting side walls of the doors are temporarily aligned in side by side, non-wiping, non-contacting and spaced apart relation.

In accordance with the alternative aspect of the present invention there is provided a refrigerator comprising a refrigerator cabinet having at least one food storage compartment and a pair of doors mounted to the refrigerator cabinet to move between an open position permitting access to the food compartment, an intermediate partially closed position covering the food storage compartment and a closed position. In the partially closed position the doors have vertically extending and confronting side walls which are aligned side by side in non-wiping, non-contacting and spaced apart relation to define a predetermined gap distance between the vertically extending and confronting side walls. At least one of the vertically extending and confronting side walls has a delayed response to the doors in the partially closed position to move laterally across the predetermined gap distance to sealingly engage the other confronting side wall to move the doors into the closed position While it is within the realm of the present invention to have lateral movement present in both the vertical extending and confronting side walls of the doors, in the aspect of using a delayed response prior to closing the door, preference is to have one of the confronting side walls of one of the doors move laterally relative to the remainder of the door and towards the other confronting side wall which remains in a stationary position. This preference is primarily for simplification of door construction. In this embodiment the refrigerator includes at least one pair of magnets and a localized side wall movement mechanism to cause the doors to move from the intermediate partially closed position to the closed position. In particular the refrigerator includes at least one pair of magnets each positioned along a face of a respective one of the confronting side walls across from each other when the doors are in the partially closed position. The at least one pair of magnets has a magnetic field strength sufficient to seal the confronting side walls in the closed position of the doors and insufficient to move the at least one movable confronting side wall towards the other confronting side wall across the predetermined gap distance. The localized side wall movement mechanism is carried by at least one of the doors adjacent the confronting side walls for moving at least one localized portion of the movable confronting side wall towards the other confronting side wall after a predetermined delay period following positioning of the doors in the partially closed position so as to reduce gap distance between the confronting side walls and permit the one pair of magnets to seal the confronting side walls in the closed position.

While the present application broadly teaches lateral movement of one of the confronting side walls towards the other confronting side wall, there is a preference to the manner in which the one confronting side wall moves into lateral sealing engagement with the other confronting side wall. The preference is to have the at least one movable confronting side wall initially move at a localized area across the predetermined gap to reduce the gap distance between the confronting side walls and thereafter the at least one moveable confronting side wall sealingly engages the other confronting side wall by sliding continually sealing contact therewith while moving vertically away from the localized area. It should be understood that depending on the vertical length of the confronting side walls it may be necessary to utilize more than one localized area to effect initial movement of the movable confronting side wall to the other confronting side wall. Further, the sliding sealing contact is a continuous moving contact where the one movable confronting side wall slides along its vertical extension into contact with the other stationary confronting side wall in a similar manner to that of a sliding fastener or closure. The sealing sliding motion resembles a wave motion.

In the delayed embodiment of the present invention the a localized side wall movement mechanism acts to move the gasket and is referred to as localized gasket movement mechanism. This mechanism includes a non-magnetic housing located on the inner face of the other confronting side wall. The housing has a rear wall opposite the inner face, a trigger magnet adapted to slide within the housing between the rear wall and the inner face over a predetermined travel distance, and a first ferromagnetic strip located against the rear wall for attracting the trigger magnet to the rear wall when at least one of the doors is open. The mechanism includes a second ferromagnetic strip carried by the localized gasket portion across from the non-magnetic housing when the doors are in the partially closed position. The trigger magnet is attracted more to the second ferromagnetic strip than the first ferromagnetic strip when the doors are in the partially closed position thereby resulting in movement of the trigger magnet towards the second ferromagnetic strip with the trigger magnet stopping at the inner face of the other confronting side wall. The second ferromagnetic strip then moves the localized gasket portion into contact with the other confronting side wall adjacent the trigger magnet. The predetermined travel distance, magnetic field strength of the trigger magnet and size of the first and second ferromagnetic materials determines the delay period before the localized gasket portion engages the other confronting side wall adjacent the trigger magnet. In the preferred embodiment, the trigger magnet is a permanent magnet which provides a relatively strong magnet field at a localized area in the vertical extension of the confronting side walls. It should be understood that any suitable magnetic attraction at this localized area may be used such as, for example, an electro magnet. Further, other mechanical time delay mechanisms could also be used to effect localized reduction of the predetermined gap distance between the confronting side walls such as, for example, time delayed spring loaded devices.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF EMBODIMENTS

Figure 1:
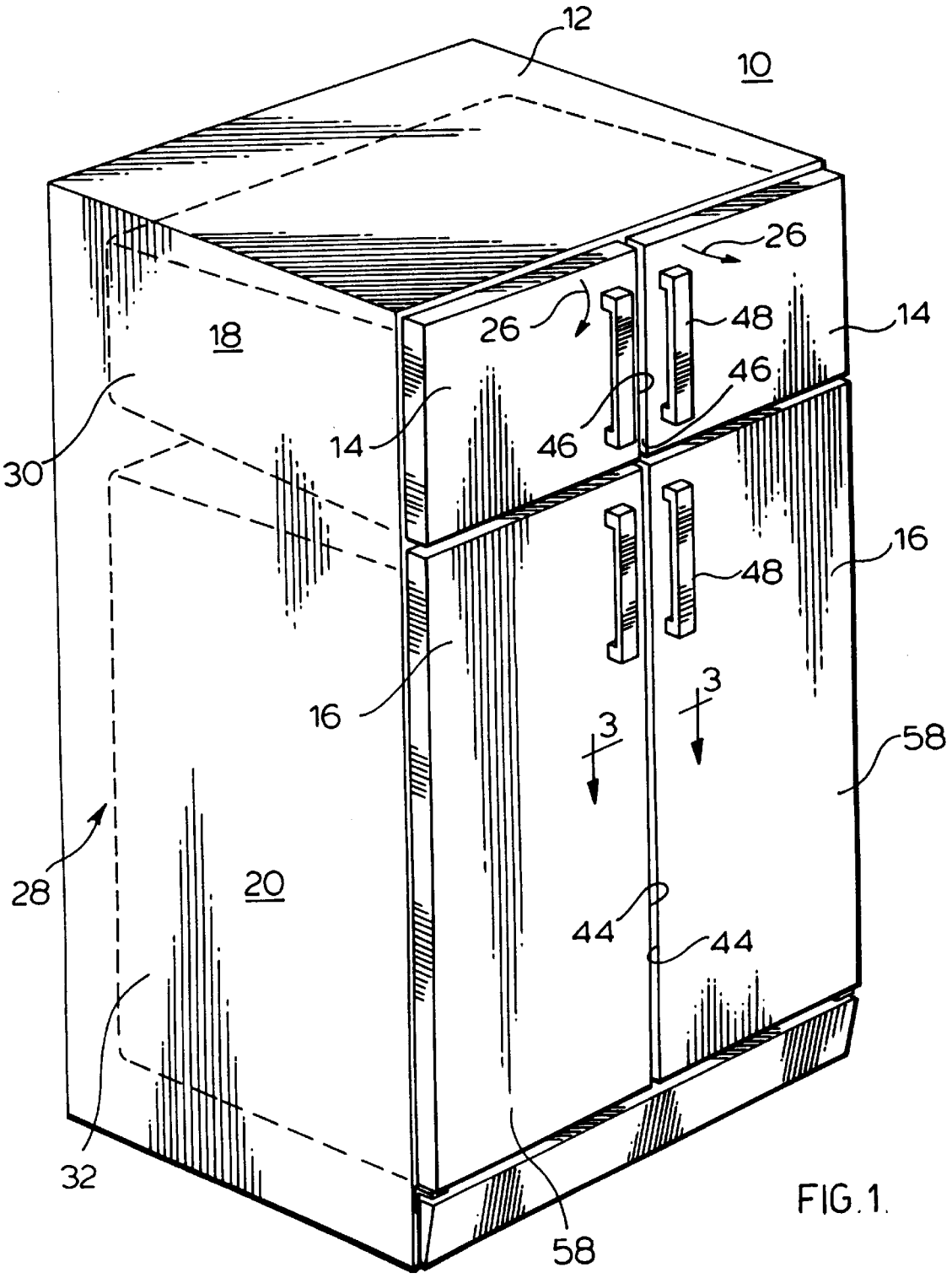
FIG. 1 is a perspective view of a refrigerator having side-by-side, or "French" doors in accordance with the present invention.
Figure 2:
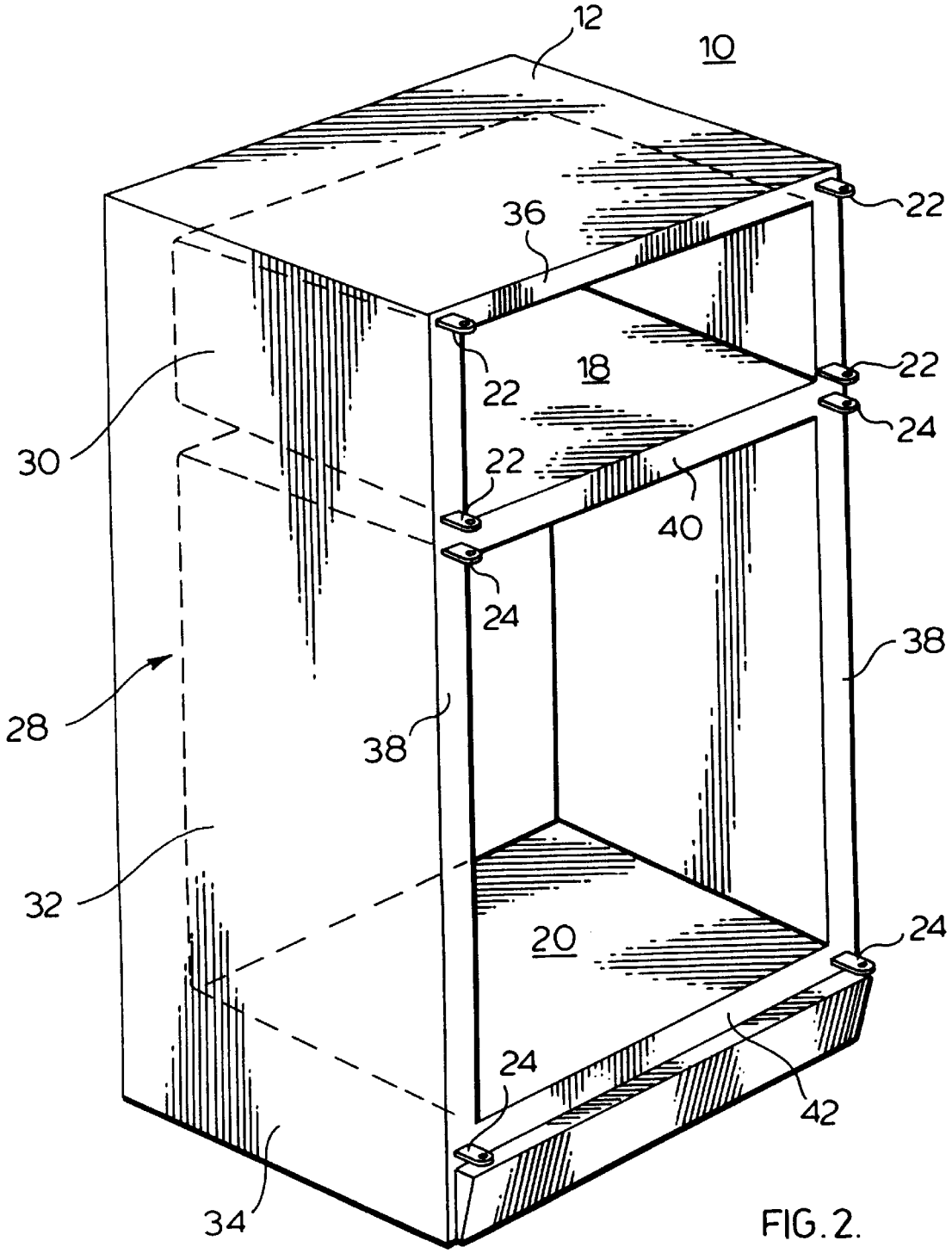
FIG. 2 is a perspective view of the refrigerator cabinet of the present invention with the side-by-side doors removed.

Referring to FIGS. 1 and 2 there is shown a refrigerator 10 having a cabinet 12 with two pairs of French doors 14 and 16 secured in a side-by-side closed position. The upper pair of French doors 14 are adapted to close the freezer food compartment 18 and the lower pair of French doors 16 are provided to close off the fresh food compartment 20. The upper pair of doors 14 are connected to the refrigerator cabinet by hinges 22 while the lower pair of French doors 16 are connected to the refrigerator cabinet through lower hinges 24. The hinge structure may be any suitable hinge provided in the art and forms no part of the present invention. The doors 14 and the pair of doors 16 pivot about the hinges from an open position permitting access to compartments 18, 20 to the closed position shown in FIG. 1.

The construction of the refrigerator cabinet 12 shown in FIG. 2 comprises inserting a plastic bubble liner 28 having an upper bubble 30 and a lower bubble 32, into an assembled refrigerator casing 34. Refrigerator casing 34 is typically formed from sheet metal and may have dimples on the side and top walls to provide a textured effect. The refrigerator casing 34 has front perimeter walls which comprise top wall 36, side walls 38, mullion wall 40 and bottom wall 42. It should be understood that the mullion wall 40 forms what is referred to throughout the specification as the top wall of the food compartment comprising the fresh food compartment 20. Additionally, the mullion 40 forms the bottom wall for the food compartment 18, typically the freezer compartment. It should be understood that each of these peripheral walls 36, 38, 40, and 42 may be formed from either the sheet metal material of the casing 34 or alternatively a leading edge plastic retainer profile which acts to hold the bubble liner 28 within the metal casing 34. Once assembled, the empty spaces in the refrigerator are filled with foam in place.

In FIGS. 3 to 7, the embodiment of the refrigerator doors utilizing an initial delayed seal closure is shown. In particular, the delayed sealing mechanism 50 for closing and sealingly engaging the vertically extending and confronting side walls 44 of the doors 16 is described. It should be understood that the delayed sealing mechanism for the upper pair of French doors 14 provided along their juxtaposition confronting side walls 46 is similar to that described for the lower doors 16.

One purpose of the delayed sealing mechanism 50 is to provide an airtight thermal barrier to prevent heat influx into the food compartment 20 between the lower doors 16 and to provide an airtight thermal barrier for the freezer compartment 18 between the upper French doors 14 when each of these pair of doors are in the closed position. It should be understood that other magnetic sealing closures are provided between cabinet walls 38, 40, and 42 and the refrigerator doors 16 to maintain the doors 16 in the closed position. To effect opening of the doors 16, a user must apply force on handles 48 to pull the doors 16 open relative to the cabinet 12.

Figure 3:
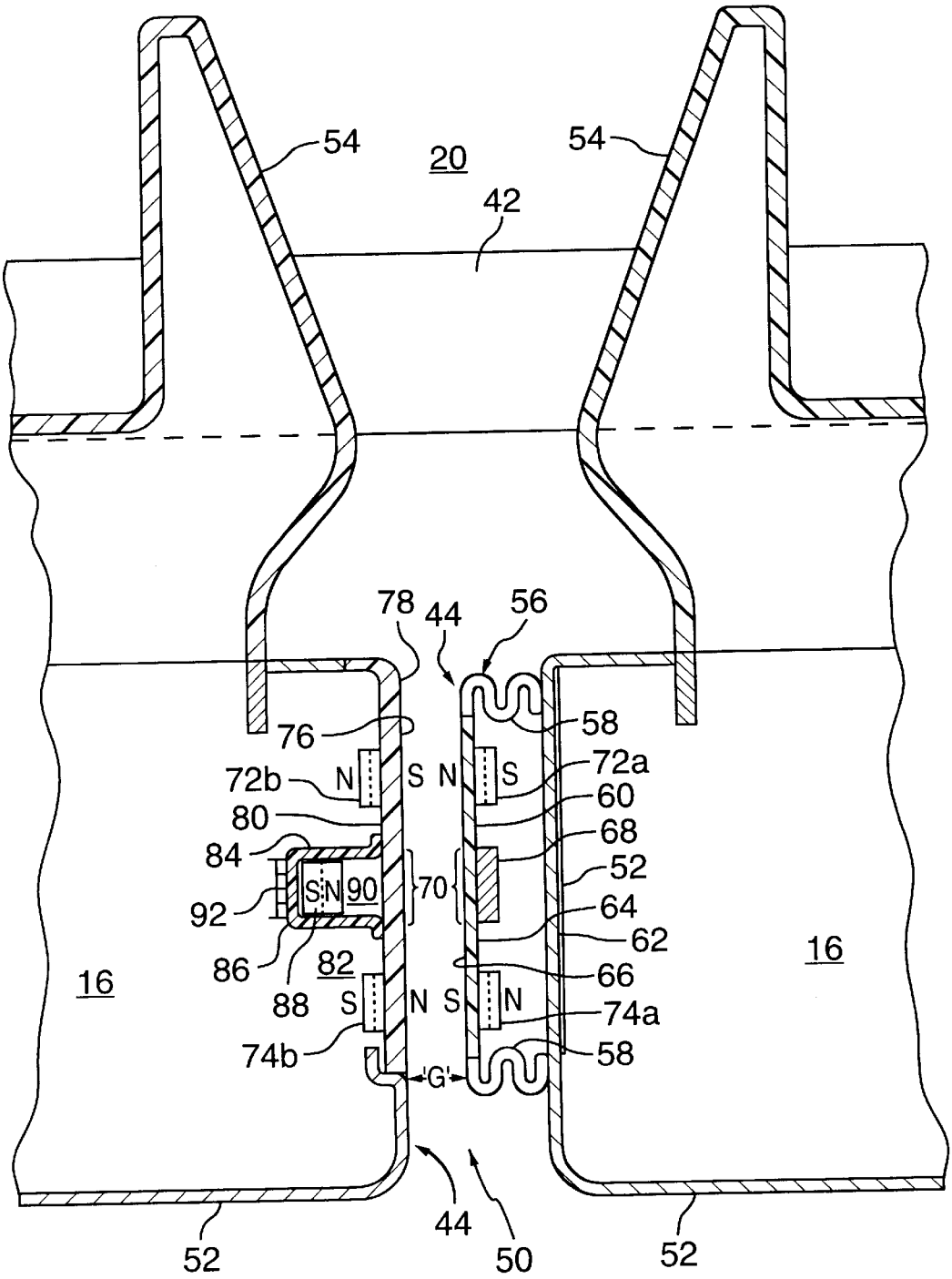
FIG. 3 is a sectional view of the side-by-side refrigerator doors taken along section lines 3—3 of FIG. 1 which shows the doors in the intermediate partially closed position.

Another purpose of the delayed sealing mechanism 50 is to provide a predetermined gap distance between confronting side walls 44 of the doors 16 when the doors 16 are moved into a temporary intermediate partially closed position as shown in FIG. 3. This intermediate partially closed position leading to door closure eliminates wiping frictional forces between confronting side walls of the doors as doors 16 are moved against the peripheral walls 38, 40 and 42 of the refrigerator cabinet 12.

Each of the doors 16 is constructed from a metal shell cover 52 covering the outside of the door 16. The inside wall of the door is typically made from a plastic liner material 54 which extends into the compartment 20 of the refrigerator cabinet 12. The interior liner 54 may further include shelving to support food articles. The interior of the refrigerator doors 16 are typically filled with a foam in place insulation.

The delayed sealing mechanism 50 comprises a movable gasket 56 connected to one of the doors 16 metallic shell cover 52. The gasket 56 includes webs 58 which are shown in a serpentine compressed position in FIG. 3. The webs 58 are a pliable plastic material and are interconnected by a rigid or semi-rigid plastic material 60. The webs 56 and the rigid or semi-rigid material or movable confronting gasket side wall 60 forms one of the confronting side walls 44 for one of the doors 16. The movable confronting gasket side wall 60 extends vertically along the edge 62 of one of the doors 16 between the top peripheral wall 40 and the bottom peripheral wall 42 of the refrigerator cabinet 12. The movable confronting gasket side wall 60 has an inner surface 64 and an outer surface 66. Mounted to the inner surface 64 of gasket side wall 60 part way down the door 16 is a first ferromagnetic plate 68. Plate 68 is rectangular in shape and defines a localized gasket area 70 immediately in front of the plate 68 on the outside surface 66 of the confronting movable side wall gasket 60. Two elongated magnetic strips are secured along the inside surface 64 of the movable confronting side wall gasket 60. The magnets are labeled 72*a* and 74*a*. Magnet 72*a* extends adjacent the inner edge of the door 16 facing the food compartment 20. Magnet 74*a* extends adjacent the outer edge of the door 16 facing the ambient.

The other confronting side wall 44 of the other door 16 comprises a stationary, rigid PVC plastic wall portion 76 having an outer surface 78 and an inner surface 80. The inner surface 80 of the stationary confronting side wall 76 supports the complementary vertically extending magnets 72*b* and 74*b* located in alignment across the predetermined gap distance "G" from the corresponding magnet pair 72*a* and 74*a*. The delayed sealing mechanism 50 further includes the localized gasket movement mechanism 82 which includes the previously described plate 68 and a plastic non-metallic housing 84 mounted to the inner surface 80 of the stationary confronting side wall 76. The housing 84 is made from a hardened plastic material such as a ABS plastic. The housing 84 includes a rear wall 86 opposite to the inner surface 80.

A slidable trigger permanent magnet 88 is located within the housing 84 and is adapted to slide within the housing between the rear wall 86 and the inside surface 80 over a predetermined travel distance 90. Another ferromagnetic plate or strip 92 is mounted to the rear wall 86 of the housing 84 for attracting the trigger magnet 88 to and against the rear wall 86 of the housing 84 when doors 16 are open. The ferromagnetic plate 92 is smaller than the ferromagnetic plate 68 secured to be inside surface 64 of the movable gasket confronting side wall 60.

Figure 4:
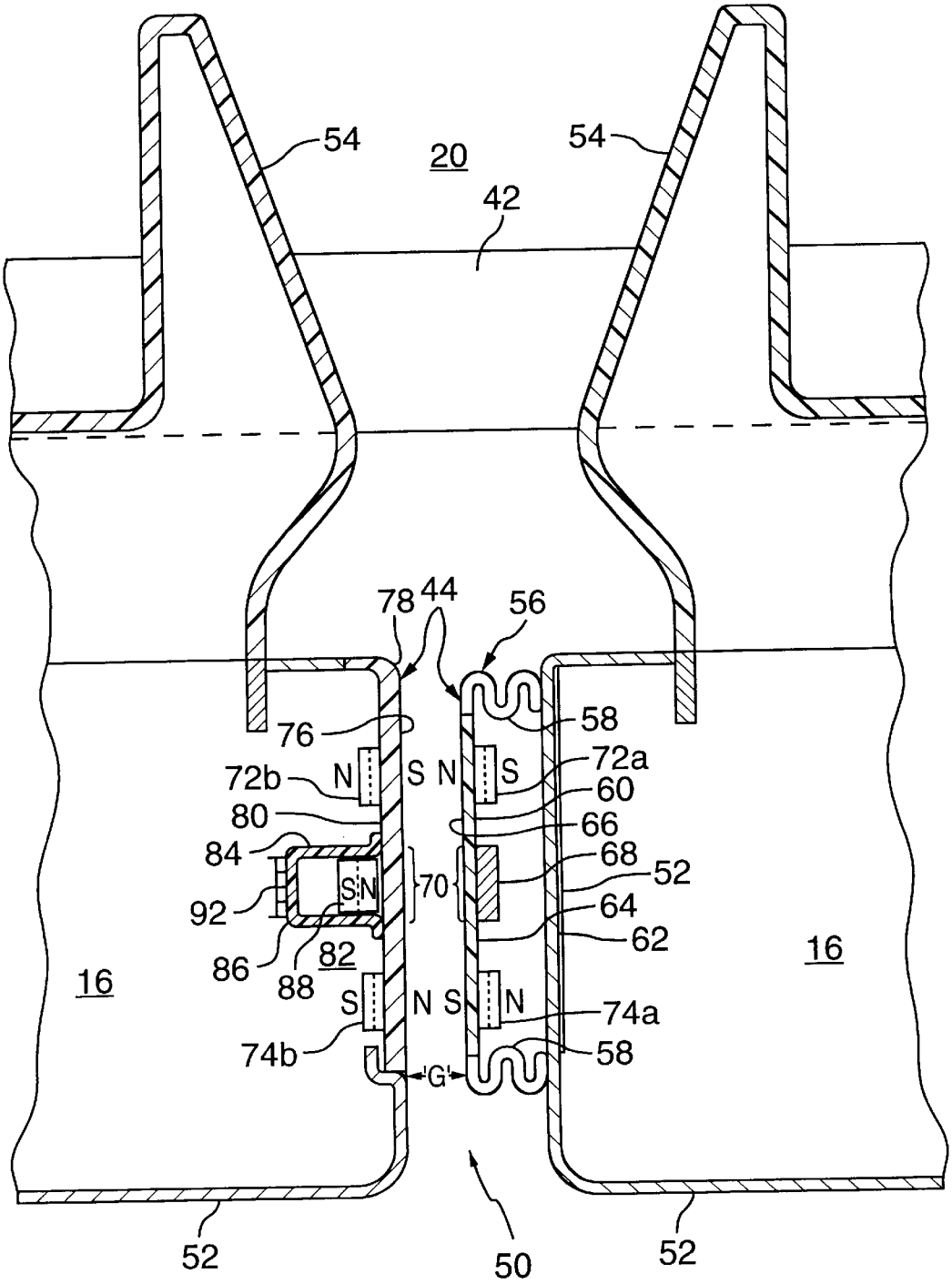
FIG. 4 is a view similar to FIG. 3 showing the doors in the intermediate partially closed position and the movement of the sliding trigger magnet of the delayed sealing mechanism of the present invention.

The operation of the delayed sealing mechanism 50 is described with reference to FIGS. 3 to 7. In FIG. 3, the doors 16 are shown with the delayed sealing mechanism 50 not activated. When a user wishes to close the doors 16 and seal shut the front of the fresh food compartment, the doors 16 are moved into the intermediate partially closed position shown in FIG. 3. The polarity of the magnet pairs 72*a,* 72*b* and 74*a,* 74*b* are as shown in FIG. 3. The opposite polarity of the corresponding magnet pairs 72*a,* 72*b* and 74*a,* 74*b* allows for attraction of these magnet pairs to establish a weak magnetic field across the predetermined gap distance "G". This predetermined gap depends on the strength of the magnets and the ferromagnetic plate size. The weak magnetic field established by the pairs of magnets 72*a,* 72*b* and 74*a,* 74*b* across gap "G" is insufficient to cause be movable gasket confronting side wall 60 to move towards the stationary confronting side wall 76. However, the strength of the permanent magnet 88 within the housing 84 becomes more attracted to the ferromagnetic plate 68 than the ferromagnetic plate 92. Consequently, magnet 88 slides in housing 84 across travel distance 90 towards the ferromagnetic plate 68. Movement of trigger magnet 88 stops at the inside surface 80 of stationary wall 76 as shown in FIG. 4. The trigger magnet 88 now acts on ferromagnetic plate 68 to pull the localized gasket area or portion 70 across gap "G".

Figure 5:
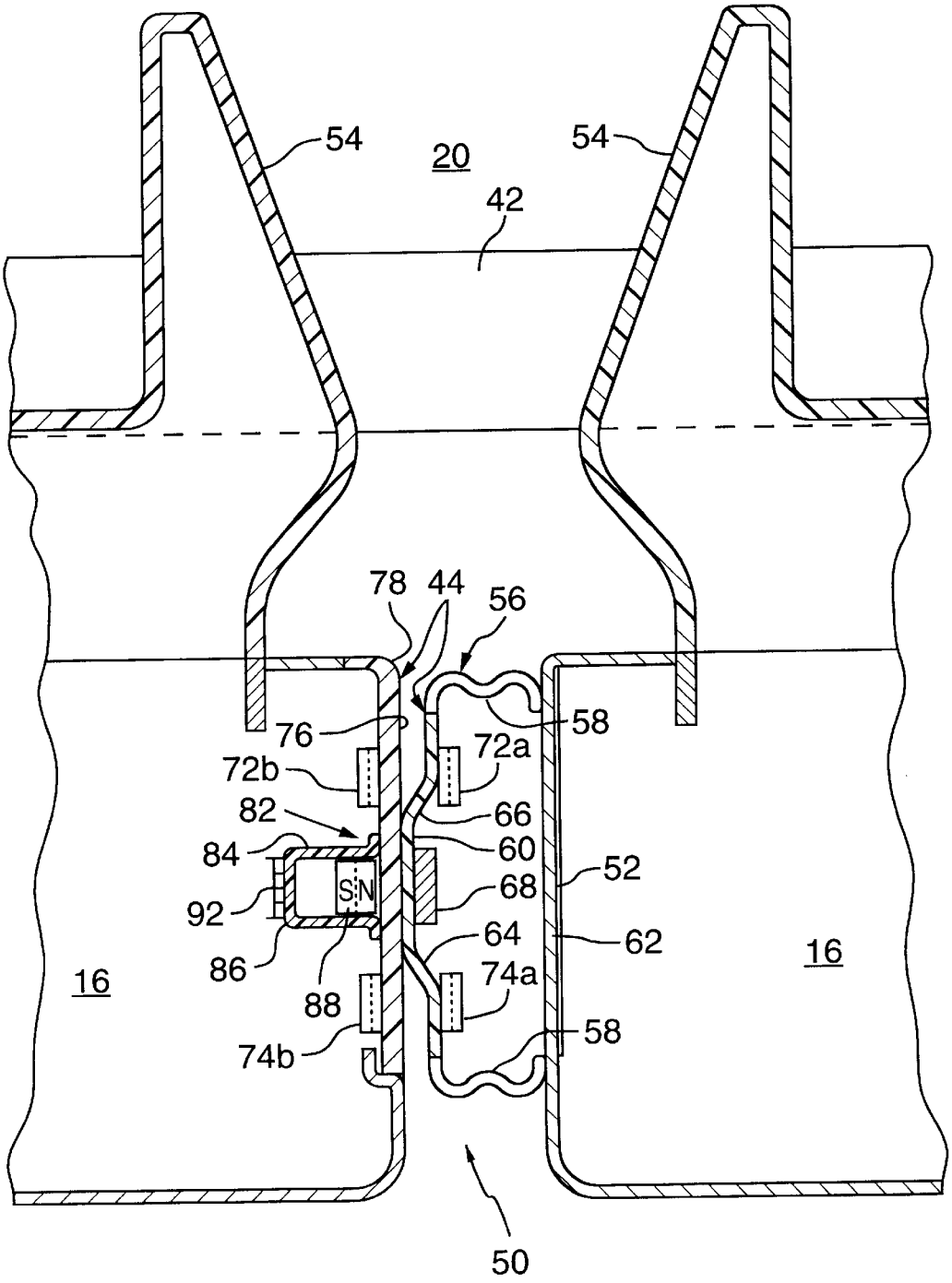
FIG. 5 is a view similar to FIGS. 3 and 4 but shows movement of the localized side wall movement mechanism moved into contact with an aligned portion of the other confronting wall.
Figure 6:
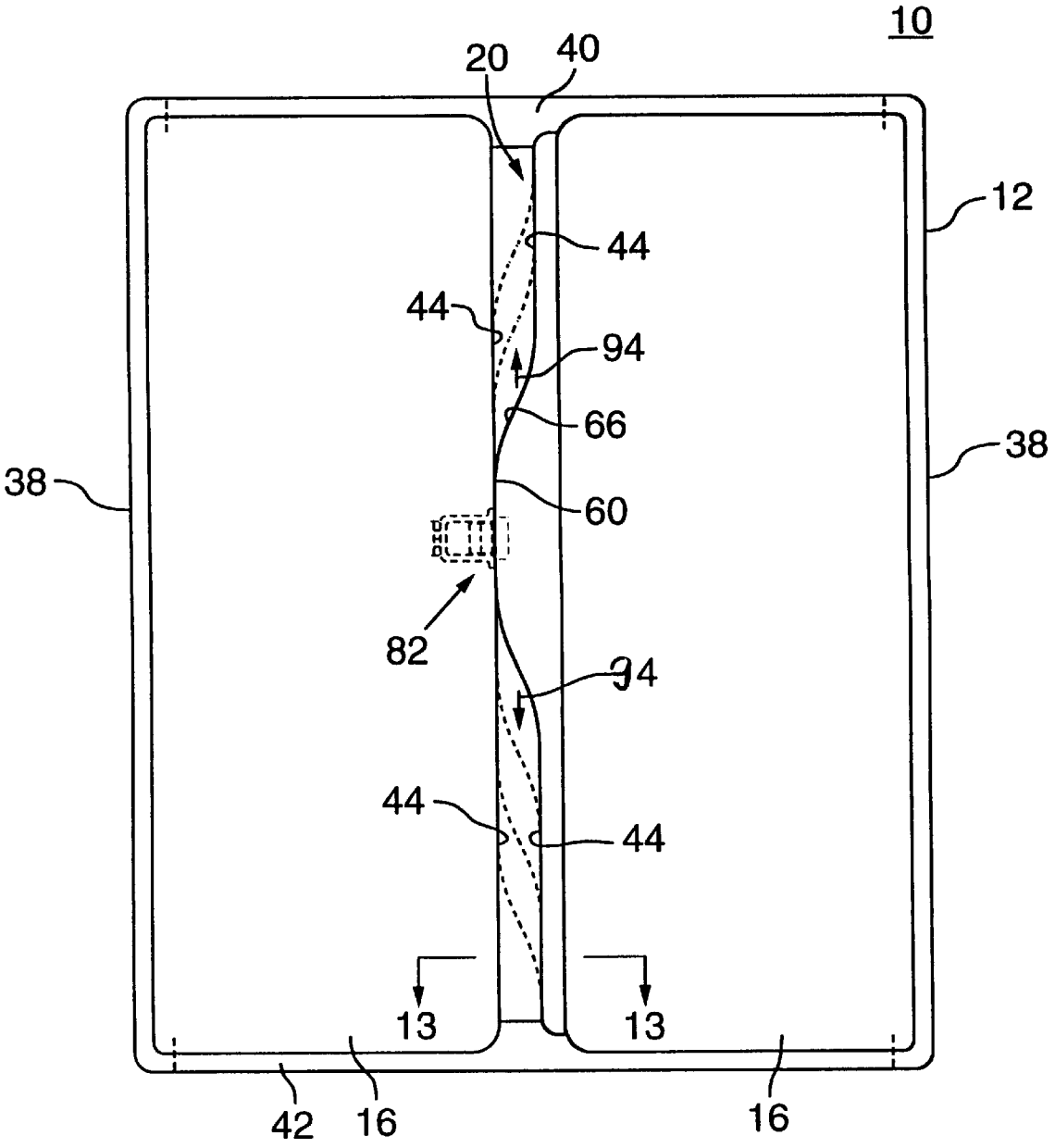
FIG. 6 is a front view showing the sliding engagement of the magnets to seal the door after the localized side wall movement mechanism has reached its position shown in FIG. 5.

Referring to FIG. 5, the localized area 70 of movable gasket confronting side wall 60 has moved into a localized position against the outside surface 78 of the stationary confronting side wall 76. Because of the semi pliable nature of the movable gasket confronting side wall 60, the magnet pairs 72*a,* 72*b* and 74*a,* 74*b* have been moved closer to each other (i.e. gap distance has been reduced) adjacent be localized area 70. The magnet pairs 72*a,* 72*b* and 74*a,* 74*b* adjacent the localized area 70 due to their closer positioning now generate an increased magnetic field of sufficient strength to cause the magnet pairs to slide the movable gasket confronting side wall 60 laterally into sealing engagement with the stationary confronting side wall 76. The sealing engagement of the confronting side walls 60, 76 continues in a continual sliding sealing engagement towards each other and vertically away from the localized area 70. This can be seen better in FIG. 6 where the continual sliding sealing closure of the movable gasket side wall 60 is represented by vertically diametrically opposed arrows 94 leading towards the upper and lower ends of the doors 16.

Figure 7:
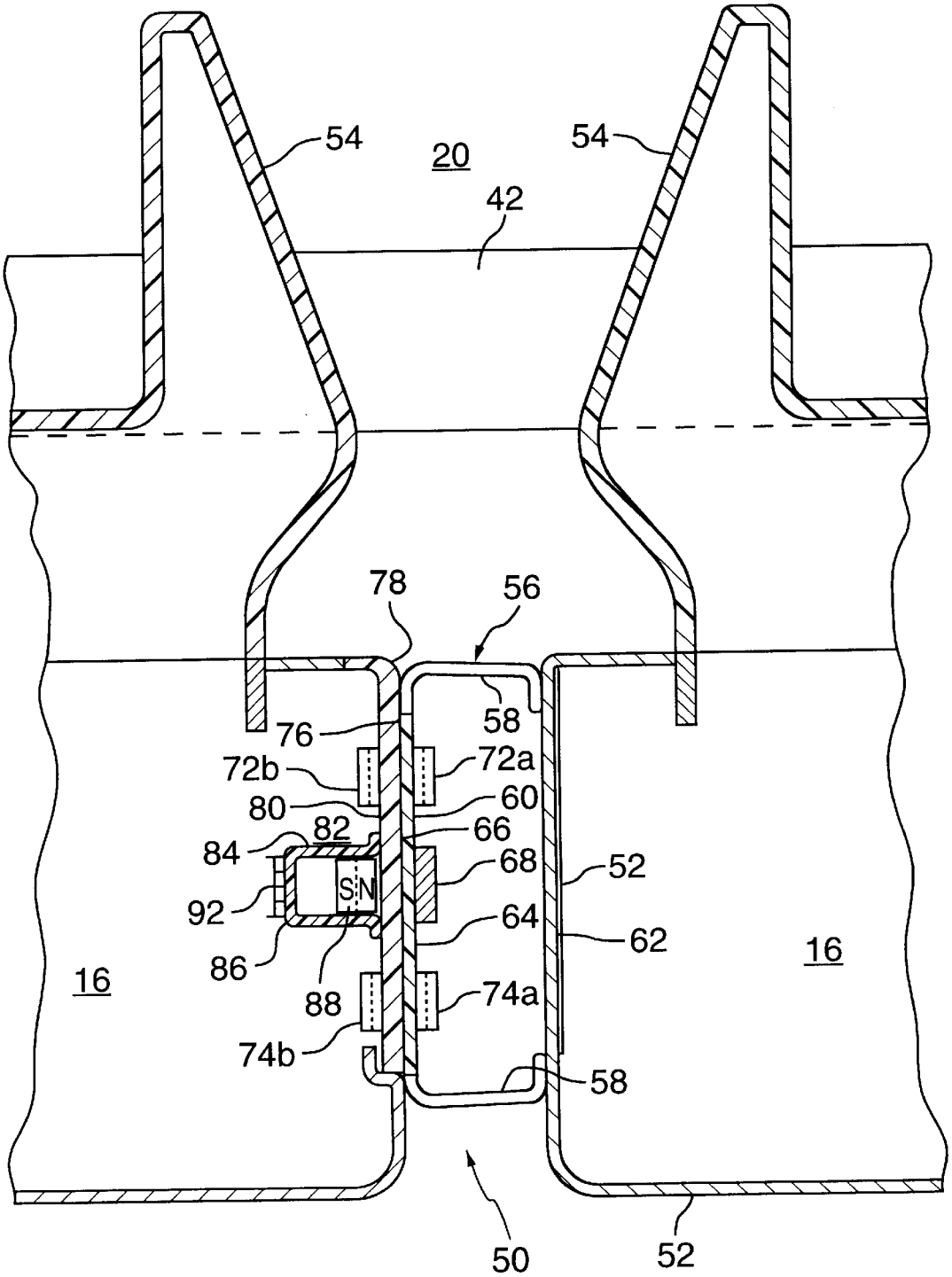
FIG. 7 is a sectional view of the side-by-side refrigerator doors taken along section lines 3—3 of FIG. 1 showing the doors in the closed position with the confronting side walls of the doors in sealed relation.

Referring to FIG. 7, there is shown a cross section where the doors 16 are shown with the confronting side walls 44 or, alternatively referred to as the movable gasket confronting side wall 66 and be stationary confronting side wall 76, in sealing engagement. It should be understood that the magnet pairs 72*a,* 72*b* and 74*a,* 74*b* are of a sufficient strength to maintain a seal along the inner and other door edges 96 and 98, respectively. The magnetic field strength of the permanent magnet 88 in the closed position of FIG. 7 is a localized magnetic force which may assist in holding the doors 16 in a closed position. However, as previously described the inside peripheral surface of the doors typically carry gaskets and magnets which sealingly magnetically engage the peripheral surface of the refrigerator cabinet 12 to maintain the doors in a closed position.

To open the doors 16, one door must be pulled away from the refrigerator cabinet 12 thereby breaking the magnetic fields with the refrigerator cabinet and between the confronting side walls 66 and 76. At this time, the webs 56 and 58 of the movable gasket confronting side wall 60 compress into the resilient serpentine shape as shown in FIG. 3. Further, the ceramic magnet 88 has its magnetic field associated with the ferromagnetic plate 68 broken and responds to the weaker magnetic field associated with the ferromagnetic plate 92 to retract within housing 84 away from the inside surface 80 of the stationary confronting side wall 76 and towards the rear wall 86 of the housing 84 resetting itself for the next door closure.

The travel distance 90, the strength of the permanent magnet 88, the size of the ferromagnetic plate 92, the size of the ferromagnetic plate 68 and the predetermined gap distance "G" determines the time delay for the initial sealing action of the movable gasket confronting side wall 60 towards the stationary confronting side wall 80. This time delay allows for the positioning of the doors 16 in the intermediate partially closed position without having any frictional contact or wiping between the confronting side walls 44 of the doors 16. Typically, the time delay after positioning the doors in the intermediate position until localized contact is made is sufficient to eliminate or minimize the friction between 66 and 76.

Further, the polarity of the magnets 72*a* and 74*b,* and 72*b* and 74*a* are the chosen to repel these magnets during door opening to facilitate the retreat of gaskets 60 from stationary wall 76. This reduces wiping during door opening.

Figure 8:
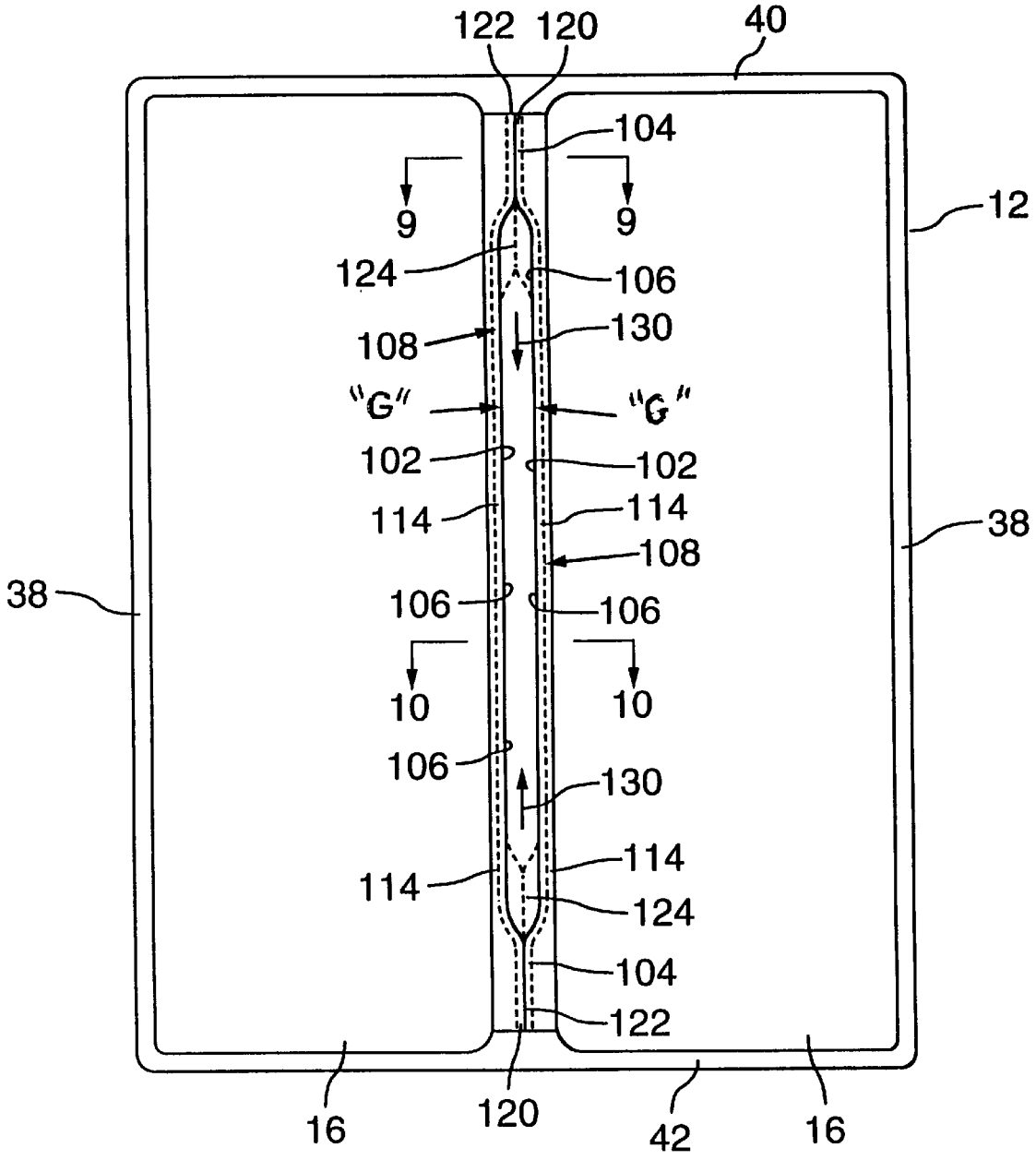
FIG. 8 is a view similar to FIG. 6 and shows the use of two movble gasketing members in accordance with the preferred embodiment of the present invention.

Referring to FIGS. 8 to 11 the preferred embodiment of the present invention is now described. FIG. 8 shows the doors 16 in the temporary intermediate partially closed position. Doors 16 extends over the open front of refrigerator compartment 12. The French doors 16 have vertically extending confronting side walls 102. Near the upper and lower ends of the refrigerator doors 16, the confronting side walls 102 are in wiping and sealing contact at 104. The confronting side walls 102 include temporary non-sealing vertically extending portions 106 that are spaced apart from one another by a predetermined gap distance "G". This predetermined gap distance is sufficient to allow either one or both of the doors 16 to close relative to the other door without the non-sealing vertically extending portions 106 of the confronting side walls 102 swiping each other. In the preferred embodiment each of the confronting side walls 102 includes a movable sealing gasket member 108.

Figure 10:
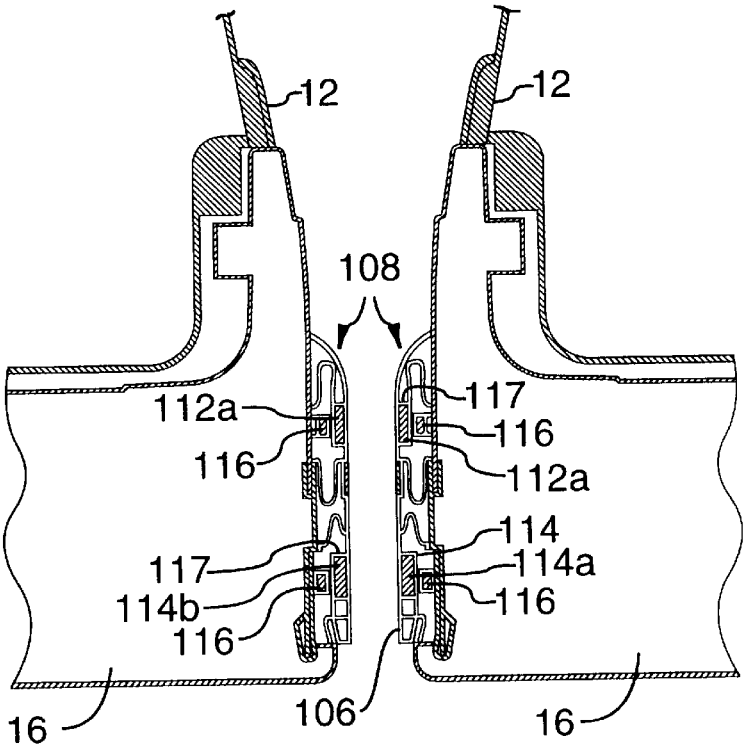
FIG. 10 is a sectional view taken at lines 10—10 of FIG. 8.
Figure 11:
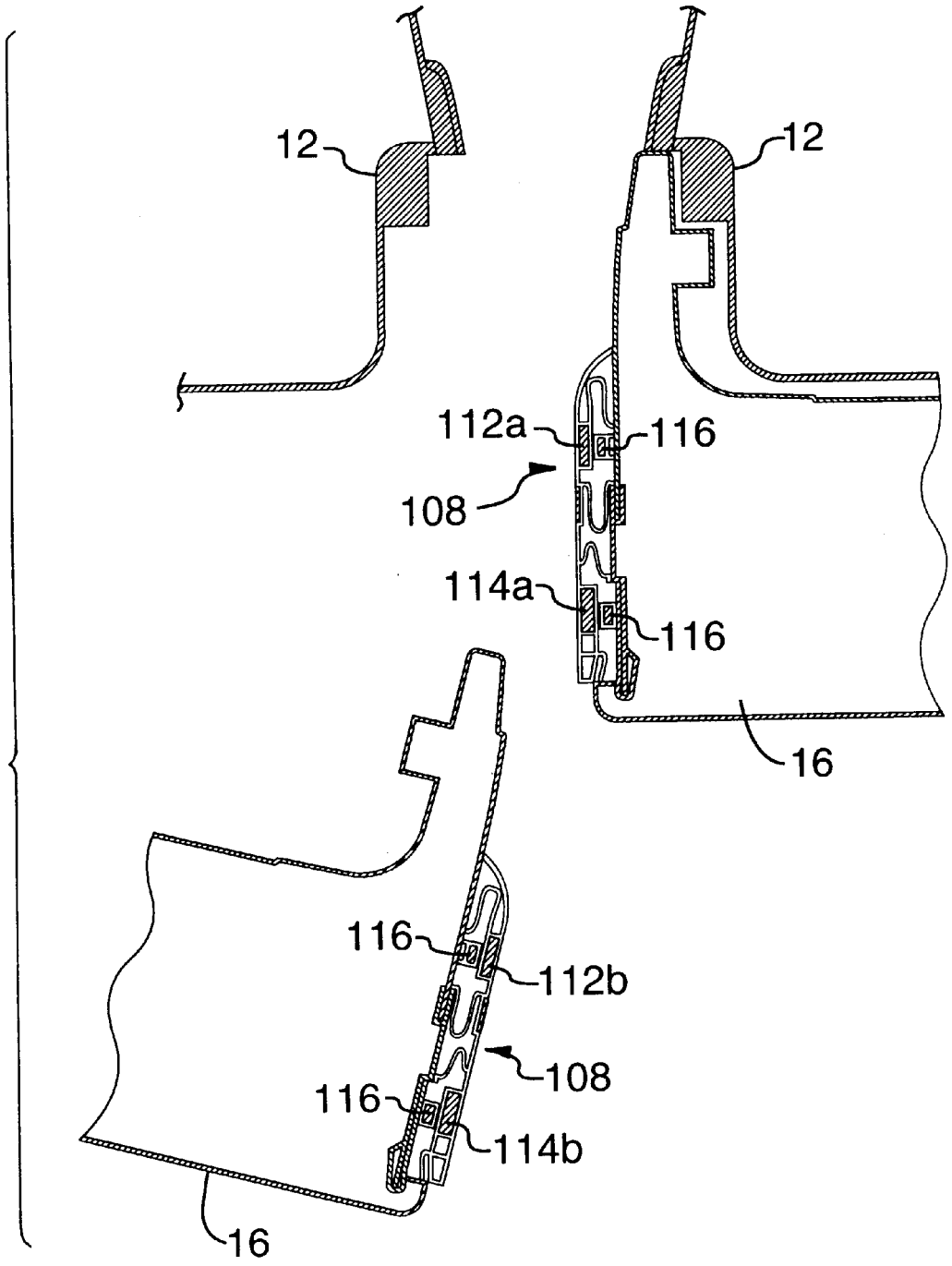
FIG. 11 is a sectional view taken at lines 10—10 of FIG. 8 with one of the doors moved into an open position.

In FIG. 10, the gasketing members 108 each include first magnetic attraction means comprising elongate flexible magnet pairs 112 and 114. Each of the magnet pairs comprises two magnets having adjacent surfaces oppositely polled so as to provide an attraction magnetic force. The magnetic attraction force of the magnetic pairs 112 and 114 is selected to be insufficient to cause the magnet pairs 112 and 114 to move the gaskets 108 into contacting and sealing engagement across the predetermined gap distance. In FIG. 10 the magnet pairs 112 and 114 extend along the temporary non-sealing vertically extending confronting surfaces 106. The first magnet pair 112 is located laterally forward of the second magnetic pair 114 so as to provide to vertically extending surfaces on the gaskets 108 that sealingly engage each other once the predetermined gap distance has been reduced. The strip magnet pairs 112 and 114 are located within hollow elongate chambers 117 adjacent an inner surface of the gasketing member. The hollow chambers 117 are carried by the gasketing member outer wall and flexible webs permit movement of the outside wall of the gasket members 108 relative to each other. The gasketing members 108 further include third magnet means in the for of strip magnets 116 which also vertically extend along the confronting door surfaces. As shown in FIGS. 10 and 11, the purpose of the third magnets 116 is to assist in the retraction of the gasketing member 108 along the temporary non-sealing portions of the gasket so that when the doors 16 are closed, the gasketing members are in a retracted non-swiping position.

Figure 9:
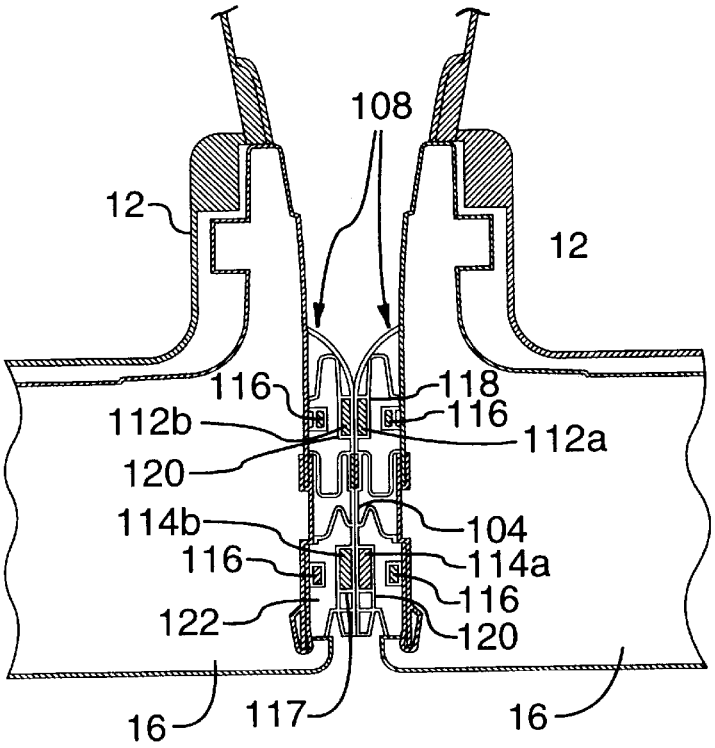
FIG. 9 is a sectional view taken at lines 9—9 of FIG. 8.

In FIG. 9, the ends of the gasketing members 108 near the top and bottom portions of the doors 16 have second magnet attraction means in the form of ceramic magnets pairs 118 and 120 that have a magnetic field or strength greater than the magnetic strength of the flexible magnet pairs 112 and 114. The ceramic magnet pairs 118 and 120 are carried in the same hollow chambers 117 as the first magnetic pairs 112 and 114. The strength of the ceramic magnets 118 and 120 is sufficient to cause the movable gasketing members 108 to contact or swipe each other during movement of the doors into the partially closed position. The ceramic magnet pairs 118 and 120 contact each other at a local area along the confronting side walls 102. This localized area is shown as 122 in FIG. 8.

It should be understood that the cross-section of FIG. 9 could also be the cross section at 10—10 of FIG. 8 when the doors 16 are in their closed position. Once the ceramic magnet pairs 118 and 120 move into swiping contact with each other the gap distance between the gasketing members 108 adjacent the ceramic members (124 of FIG. 8) is reduced to be less than the predetermined gap distance. In FIG. 8, while this Figure has been referred to as showing doors 16 in the partially closed position, it should be understood that the Figure actually shows the doors 16 in a partially closed position with the flexible magnetic strips 114, 116 of the gasketing members 108 in the process of closing the gap between the confronting surfaces 106. This is illustrated by broken lines showing the closure of the gap as the gasketing member 108 closes vertically away from the ceramic magnets 120 in the direction of converging arrows 130. Typically the ceramic magnets 118, 120 are 1 to 1.5 inches in length with the flexible magnets 112 and 114 extending over a majority of the vertical length of the confronting surfaces 102 of the refrigerator doors 16 which could be as much as 33 inches or more. Further, if necessary additional ceramic magnets can be placed in the hollow chambers 117 of the gasketing members 108 towards the middle of the refrigerator doors 16 between the top and bottom ends thereof to reduce the time seal the doors.

In this preferred embodiment during door closure, the doors 16 are in the temporary intermediate partially closed position with the ceramic magnet pairs providing localized gasket contact. This reduces the predetermined gap distance between the confronting walls of the gasketing members 108 initially adjacent the localized contact areas. As a result, the flexible magnetic strips move towards each other continually reducing and closing the predetermined gap distance in a sliding closure motion.

The magnetic polarities of magnetic strips 112*a,* 112*b* are chosen to be opposite to attract these magnet pairs when the doors are closed. The magnetic polarities of magnet strips 114*a,* 114*b* are also opposite to attract these magnet pairs when the doors are closed. This is similar to the polarities shown for magnets 72*a,* 72*b,* 74*a,* and 74*b* in FIG. 3. The polarities of magnetic strips 112*a,* 114*b* and strips 112*b,* 114*a* are the same to cause these magnet pairs to repel each other as the magnets pass by each other during swinging movement of one door relative to other. It should be understood that the gap distance between doors may change as the identically polled pairs 112*a,* 114*b* and 112*b,* 114*a* pass by each other in a repelling relation. The magnetic polarities of the trigger magnets pairs 118 and 120 are chosen to be the same as the magnetic strips pairs 112 and 114, respectively.

Figure 12:
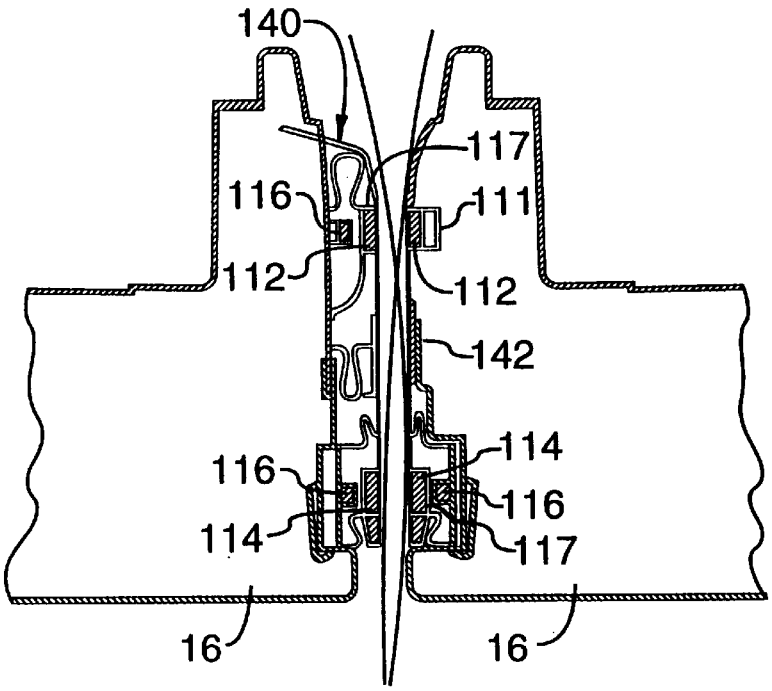
FIG. 12 is a sectional view of the gasketing member of an alternative embodiment; and, FIG. 13. is a sectional view taken of the gasketing member of FIG. 12 taken at another point or instant in closing.
Figure 13:
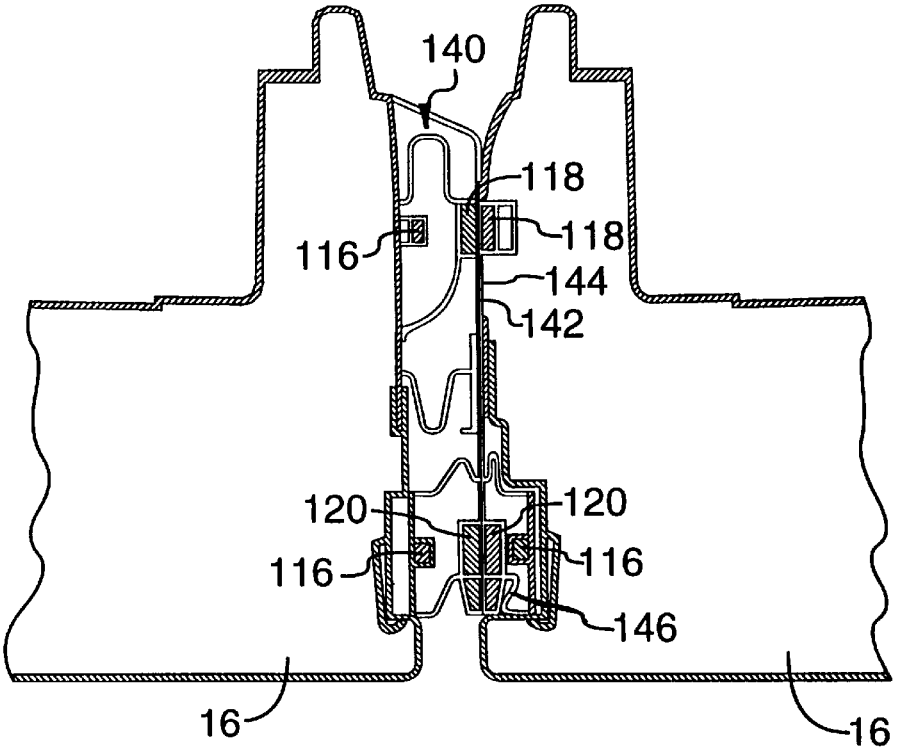

Referring to FIGS. 12 and 13 there are shown cross-sectional views of the confronting side walls of the refrigerator doors 16. In these figures one of the confronting side walls includes a flexible gasketing member 140 which is very similar to the gasketing member 108 of FIGS. 9 and 10. Like functioning parts in this embodiment to the parts in the preferred embodiment of FIGS. 9 and 10 have been numbered the same. Again, the ceramic magnets 118 and 120 are located at predetermined positions at the top and bottom of the doors 16. The ceramic magnets 118 and 120 extend in hollow chambers 117 with the flexible magnet strips 112 and 114 providing a continuous magnetic surface in series with the ceramic magnets. In this embodiment, the other confronting side wall 142 to the flexible gasketing member 140 comprises a stationary wall 144 and a second movable gasket 146 carrying one of the magnet strips 114 and ceramic magnets 120.

In the preferred embodiment of FIGS. 8 to 11 and in the alternative embodiment of FIGS. 10 and 11, the ceramic magnets 118 and 120 act as trigger magnets triggering the sliding closure by the flexible strip magnets 114, 116 of the remainder of the vertically extending gasket side walls. There is effectively no delay in the initial closure of the gap between the confronting side walls of the doors because the strength of the ceramic magnets is chosen to cause local swiping contact of the confronting surfaces of the gasketing members. The advantage with this French door closure sealing arrangement is the swiping contact during relative closing motion between the doors is limited to a localized area adjacent the ceramic magnets.

It will be appreciated that alternative embodiments falling within the scope of the present invention may be apparent to those skilled in the art of refrigerator door construction and accordingly the present invention should not be limited to those embodiments herein described.

What is claimed is:

1. A refrigerator comprising:

a refrigerator cabinet having at least one food storage compartment having an open front;

a pair of French doors pivotally mounted to the refrigerator cabinet and having vertically extending confronting side walls, the confronting side walls each including a movable sealing gasketing member adapted to sealingly engage the other gasketing member of the other confronting side wall when the doors extend across the open front of the refrigerator cabinet in a closed position, and the doors being movable between an open position, permitting access to the food compartment, and into the closed position through a temporary intermediate partially closed position in which the doors extend over the open front of the compartment with temporary non-sealing vertically extending portions of each of the gasket members of the confronting side walls spaced apart from one another a predetermined gap distance in side by side, non-wiping and non-contacting relation; and, first magnetic attraction means positioned within each of the gasket members along the temporary non-sealing vertically extending portions of the gasket members, the first magnetic attraction means having a magnetic field attraction strength insufficient to move the gasketing members across the predetermined gap distance and sufficient to seal the gasketing members to each other when the predetermined gap distance is reduced; and second magnetic attraction means, having a magnetic field strength greater than the first magnetic attraction means, positioned in at least one location along in each of the gasketing members to trigger local movement of the gasketing members towards each other to reduce the predetermined gap at the one location whereby the first magnetic attraction adjacent the one location moves the temporary non-sealing vertically extending portions of the gasket members across the reduced gap distance into sealing engagement.

2. The refrigerator of claim 1 wherein the gasketing members have flexible confronting surfaces permitting initial sealing contact at the one location and subsequent sliding closure in a vertical direction away from the one location as the predetermined gap distance is reduced.

3. The refrigerator of claim 1 wherein the non-sealing vertical extending portions of the gasketing members comprise a major length of each of said doors.

4. The refrigerator of claim 1 wherein said second magnet attraction means magnet is located as a continuation of and in alignment with the first magnet attraction means, and wiping of the confronting side walls of the doors occurring only at the one location as the doors are moved into the partially closed position.

5. The refrigerator of claim 1 wherein said first magnet attraction means includes at least one pair of strip magnets with each each strip magnet in the pair positioned along a face of a respective one of the confronting side walls across from each other when the doors are in the partially closed position.

6. The refrigerator of claim 1 wherein said first magnet attraction means includes two pairs of strip magnets with each pair positioned along a face of a respective one of the confronting side walls across from each other when the doors are in the partially closed position, the first pair of strip magnets being spaced laterally outward from the second pair of strip magnets.

7. The refrigerator of claim 1 wherein the strip magnets of the first pair of magnets are oppositely magnetically poled, the strip magnets of the second pair of magnets are oppositely polled, and each strip magnet of the first pair of magnets adapted to repel the strip magnet of the second pair of magnets located in the other confronting side wall during movement of one door relative to the other.

8. The refrigerator of claim 1 wherein each of the gasketing members comprise a forward gasket portion and a rearward gasket portion position in side by side vertical extension with the forward gasket portion located closer to the refrigerator cabinet, each of the forward and rearward gasket portions including an elongate chamber in which first and second magnetic strips respectively extend, the first magnetic strips comprising a part of the first magnetic attraction means.

9. The refrigerator of claim 8 wherein the elongate chambers are mounted through flexible gasket walls to a rear wall of each of the forward and rearward gasket portions, each rear wall carrying a third magnet means adapted to attract the first magnet strips thereto when the doors are in the open position so as to collapse the gasketing member back towards the rear wall.

10. The refrigerator of claim 8 wherein the second magnet attraction means includes a second elongate magnet extending within the hollow chambers of each of the forward and rearward gasket portions at least at top and bottom of these chambers adjacent top and bottom portions of the doors.

11. The refrigerator of claim 1 wherein the second magnet attraction means includes a delayed sealing mechanism triggers movement of the gasketing member towards the other confronting side a predetermined time delay period after the doors are moved into the intermediate partially closed position such that the confronting side walls of the doors are aligned in side by side, non-wiping, non-contacting and spaced apart relation.

12. A refrigerator comprising:

a refrigerator cabinet having at least one food storage compartment having an open front;

a pair of French doors pivotally mounted to the refrigerator cabinet and having vertically extending confronting side walls, at least one of the confronting side walls comprising a movable sealing gasketing member adapted to sealingly engage the other confronting side wall when the doors extend across the open front of the refrigerator cabinet in a closed position, and the doors being movable between an open position, permitting access to the food compartment, and into the closed position through a temporary intermediate partially closed position in which the doors extend over the open front of the compartment with temporary non-sealing vertically extending portions of the confronting side walls of the doors spaced apart from one another a predetermined gap distance in side by side, non-wiping and non-contacting relation; and, first magnetic attraction means positioned in the doors at least along the temporary non-sealing vertically extending portions of the confronting side walls, the first magnetic attraction means having a magnetic field attraction strength insufficient to move the gasketing member across the predetermined gap distance and sufficient to seal the gasketing member to the other confronting side wall when the predetermined gap distance is reduced; and second magnetic attraction means, having a magnetic field strength greater than the first magnetic attraction means, positioned in at least one location along each of the confronting side walls to trigger movement of the gasketing member towards the other confronting side wall to reduce the predetermined gap at the one location whereby the first magnetic attraction means adjacent the one location moves the temporary non-sealing vertically extending portions of the confronting side walls across the reduced gap distance into sealing engagement.

13. The refrigerator of claim 12 wherein the gasketing member has a flexible confronting surface permitting initial sealing contact at the one location and subsequent sliding closure in a vertical direction away from the one location as the predetermined gap distance is reduced.

14. The refrigerator of claim 12 wherein the non-sealing vertical extending portions of the confronting side walls comprise a major length of each of said doors.

15. The refrigerator of claim 12 wherein said second magnet attraction means magnet is located as a continuation of and in alignment with the first magnet attraction means, and wiping of the confronting side walls of the doors occurring only at the one location as the doors are moved into the partially closed position.

16. The refrigerator of claim 12 wherein said first magnet attraction means includes at least one pair of strip magnets each positioned along a face of a respective one of the confronting side walls across from each other when the doors are in the partially closed position.

17. The refrigerator of claim 12 wherein said first magnet attraction means includes two pairs of strip magnets with each pair positioned along a face of a respective one of the confronting side walls across from each other when the doors are in the partially closed position, the first pair of strip magnets being spaced laterally outward from the second pair of strip magnets.

18. The refrigerator of claim 12 wherein the gasketing member comprises a forward gasket portion and a rearward gasket portion position in side by side vertical extension with the forward gasket portion located closer to the refrigerator cabinet, each of the forward and rearward gasket portions including an elongate chamber in which first magnetic strips extend, the first magnetic strips comprising a part of the first magnetic attraction means, the other confronting side wall carrying corresponding second magnetic strips in alignment with the first magnetic strips when the doors are in the partially closed position.

19. The refrigerator of claim 18 wherein the elongate chambers are mounted through flexible gasket walls to a rear wall of each of the forward and rearward gasket portions, each rear wall carrying a third magnet means adapted to attract the first magnet strip thereto when the doors are in the open position so as to collapse the gasketing member back towards the rear wall.

20. The refrigerator of claim 19 wherein the second magnet attraction means includes a second elongate magnet extending along the one location housed within the hollow chambers of at least one of the forward and rearward housings and the corresponding third elongate magnets positioned in the other confronting side wall at the one location.

21. The refrigerator of claim 20 wherein the other confronting side wall includes a second movable gasketing member carrying one of the second magnet strips in a second hollow chamber aligned with the first magnet strips of a selected one of the forward or rearward gasket portions, the second movable gasketing member includes a fourth magnet means mounted to a rear wall of the second movable gasketing member to retract the second magnet strips located in the second hollow chamber.

22. The refrigerator of claim 21 wherein the second movable gasketing member is aligned across from the rearward gasket portion.

23. The refrigerator of claim 22 wherein the second magnet attraction means includes a delayed sealing mechanism triggers movement of the gasketing member towards the other confronting side a predetermined time delay period after the doors are moved into the intermediate partially closed position such that the confronting side walls of the doors are aligned in side by side, non-wiping ,non-contacting and spaced apart relation.

24. The refrigerator of claim 23 wherein the gasket member having an inside surface and the other confronting side wall including a rigid plastic wall having an inside surface; the delayed sealing mechanism includes:

at least one first ferromagnetic plate attached to the inside surface of the gasket member at the one location;

a non-magnetic housing mounted to the inside surface of the rigid plastic wall for housing a sliding magnet, the housing having a rear wall carrying a second ferromagnetic plate to which the sliding magnet is attracted when the doors are the open position, the housing being aligned across from the first ferromagnetic plate carried by the gasket member in the partially closed position, the sliding magnet sliding towards the inside surface of the rigid plastic wall when the doors are in the partially closed position, duration of travel of the sliding magnet in the housing substantially determining the predetermined delay time period; and, the gasketing member at the one location moving towards the other rigid plastic wall after the sliding magnet moves towards the rigid plastic wall to locally reduce gap distance at the one location.

25. A refrigerator comprising a refrigerator cabinet having at least one food storage compartment and a pair of doors mounted to the refrigerator cabinet to move between an open position permitting access to the food compartment, an intermediate partially closed position covering the food storage compartment and a closed position, in the partially closed position the doors having vertically extending and confronting side walls which are aligned side by side in non-wiping, non-contacting and spaced apart relation to define a predetermined gap distance between the vertically extending and confronting side walls, at least one of the vertically extending and confronting side walls having a delayed response to the doors in the partially closed position to move laterally across the predetermined gap distance to sealingly engage the other confronting side wall and to move the doors into the closed position.

26. The refrigerator of claim 25 further comprising:

at least one pair of magnets each positioned along a face of a respective one of the confronting side walls across from each other when the doors are in the partially closed position, the at least one pair of magnets having a magnetic field strength sufficient to seal the confronting side walls in the closed position of the doors and insufficient to move the at least one movable confronting side wall towards the other confronting side wall across the predetermined gap distance; and, a localized side wall movement mechanism carried by at least one of the doors adjacent the confronting side walls for moving at least one localized portion of the movable confronting side wall towards the other confronting side wall after a predetermined delay period following positioning of the doors in the partially closed position to reduce gap distance between the confronting side walls and permit the one pair of magnets to seal the confronting side walls in the closed position.

27. The refrigerator of claim 25 wherein the at least one movable confronting side wall initially moves at a localized area across the predetermined gap to reduce the gap distance between the confronting side walls and thereafter the at least one moveable confronting side wall sealingly engages the other confronting side wall by continual sliding sealing contact therewith while moving vertically away from the localized area.

28. The refrigerator of claim 25 wherein the at least one moveable confronting side wall comprises a moveable gasket attached to one of the doors.

29. The refrigerator of claim 25 further including:

at least one pair of magnetic strips each positioned along a face of a respective one of the confronting side walls across from each other when the doors are in the partially closed position, the at least one pair of magnetic strips having a magnetic field strength sufficient to seal the gasket to the other confronting side wall and insufficient to move the gasket across the predetermined gap distance; and, a localized gasket movement mechanism carried by said doors adjacent the confronting side walls for moving at least one localized portion of the gasket towards the other confronting side wall after a predetermined delay period following positioning of the doors in the partially closed position to locally reduce gap distance between the confronting side walls, and the one pair of magnet strips causing the gasket of the one confronting side wall to move into sealing engagement with the other confronting side wall initially adjacent the at least one localized gasket portion and subsequently the remainder of the gasket moving in continual sliding sealing engagement towards the other confronting side wall while moving vertically away from the at least one localized gasket portion.

30. The refrigerator of claim 29 wherein the localized gasket movement mechanism comprises:

a non-magnetic housing located on the inner face of the other confronting side wall, the housing having a rear wall opposite the inner face, a trigger magnet adapted to slide within the housing between the rear wall and the inner face over a predetermined travel distance, a first ferromagnetic strip located against the rear wall for attracting the trigger magnet to the rear wall when at least one of the doors is open;

a second ferromagnetic strip carried by the localized gasket portion across from the non-magnetic housing when the doors are in the partially closed position; and, the trigger magnet being attracted more to the second ferromagnetic strip than the first ferromagnetic strip when the doors are in the partially closed position thereby resulting in movement of the trigger magnet towards the second ferromagnetic strip with the trigger magnet stopping at the inner face of the other confronting side wall, the second ferromagnetic strip moving the localized gasket portion into contact with the other confronting side wall adjacent the trigger magnet, the predetermined travel distance, magnetic field strength of the trigger magnet and size of the first and second ferromagnetic materials determining the delay period before the localized gasket portion engages the other confronting side wall adjacent the trigger magnet.

31. The refrigerator of claim 30 wherein two pairs of magnetic strips are utilized to seal the gasket of the one confronting side wall to the other confronting side wall, the two pairs of strips extending along inner and outer edges of the side walls.

32. The refrigerator of claim 31 wherein the localized gasket movement mechanism comprises:

a non-magnetic housing located on the inner face of the other confronting side wall, the housing having a rear wall opposite the inner face, a trigger magnet adapted to slide within the housing between the rear wall and the inner face over a predetermined travel distance, a first ferromagnetic strip located against the rear wall for attracting the trigger magnet to the rear wall when at least one of the doors is open;

a second ferromagnetic strip carried by the localized gasket portion across from the non-magnetic housing when the doors are in the partially closed position; and, the trigger magnet being attracted more to the second ferromagnetic strip than the first ferromagnetic strip when the doors are in the partially closed position thereby resulting in movement of the trigger magnet towards the second ferromagnetic strip with the trigger magnet stopping at the inner face of the other confronting side wall, the second ferromagnetic strip moving the localized gasket portion into contact with the other confronting side wall adjacent the trigger magnet, the predetermined travel distance, magnetic field strength of the trigger magnet and size of the first and second ferromagnetic materials determining the delay period before the localized gasket portion engages the other confronting side wall adjacent the trigger magnet.

33. A refrigerator comprising:

a refrigerator cabinet having at least one food storage compartment;

a pair of doors mounted to the refrigerator cabinet to move between an open position permitting access to the food compartment, an intermediate partially closed position covering the food storage compartment and a closed position, and the doors having vertically extending confronting side walls which sealingly engage each other when the doors are in the closed position; and, a delayed sealing mechanism positioned adjacent the confronting side walls in the doors to move the doors into mutually sealing relation a predetermined time delay period after the doors are moved into the intermediate partially closed position with the confronting side walls aligned in side by side, non-wiping non-contacting and spaced apart relation to define therebetween a predetermined gap distance, the delayed sealing mechanism comprising:

a first door of the pair of doors including a movable gasket defining a first one of the confronting side walls, the gasket having an inside surface;

at least one first ferromagnetic plate attached to the inside surface of the gasket at a localized gasket portion;

at least one first magnetic strip of material running vertically along the inside surface of the movable gasket;

a second door of the pair of doors including a rigid plastic wall defining a second stationary confronting side wall and having an inside surface;

at least one second magnetic strip of material running vertically along the inside surface of the rigid plastic wall positioned in vertical alignment with the corresponding one first magnet strip spaced across the predetermined gap distance from the first confronting wall when the doors are in the partially closed position, the first and second magnetic strips producing a magnetic field strength sufficient to seal the gasket to the rigid plastic wall and insufficient to move the gasket across the predetermined gap distance;

a non-magnetic housing mounted to the inside surface of the rigid plastic wall for housing a sliding magnet, the housing having a rear wall carrying a second ferromagnetic plate to which the sliding magnet is attracted when the doors are the open position, the housing being aligned across from the first ferromagnetic plate carried by the gasket, the sliding magnet sliding towards the inside surface of the rigid plastic wall when the doors are in the partially closed position, duration of travel of the sliding magnet in the housing substantially consuming the predetermined delay time period; and, the localized gasket portion carrying the first ferromagnetic plate moving towards the other rigid plastic wall after the sliding magnet moves towards the rigid plastic wall to locally reduce gap distance between the localized gasket portion and the rigid plastic wall, and the first and second magnetic strips causing the gasket to move into sealing engagement initially with the rigid plastic wall adjacent the at least one localized gasket portion and thereafter continual sliding engagement along the rigid plastic wall and vertically away from the at least one localized gasket portion.

34. The refrigerator of claim 33 wherein two pairs of magnetic strips are utilized to seal the gasket of the one confronting side wall to the other confronting side wall, the two pairs of strips extending along inner and outer edges of the side walls.

* * * * *